US007246685B2

(12) United States Patent
Tyree

(10) Patent No.: US 7,246,685 B2
(45) Date of Patent: Jul. 24, 2007

(54) FORKLIFT GUARD

(75) Inventor: Jerry C. Tyree, Waynesboro, VA (US)

(73) Assignee: Target Brands, Inc., Minneapolis, MN (US)

( * ) Notice: Subject to any disclaimer, the term of this patent is extended or adjusted under 35 U.S.C. 154(b) by 105 days.

(21) Appl. No.: 10/889,964

(22) Filed: Jul. 13, 2004

(65) Prior Publication Data

US 2006/0151250 A1 Jul. 13, 2006

(51) Int. Cl.
*B66F 9/12* (2006.01)

(52) U.S. Cl. ..... 187/237; 187/222; 187/414; 414/668; 414/785; 414/787; 108/27; 108/29; 108/56.3; 108/57.33

(58) Field of Classification Search ..... 187/222, 187/237, 414; 414/668, 629, 785, 787; 108/27, 108/29, 56.3, 57.19, 57.33; 211/13.1, 41.14, 211/41.15, 71.01, 183
See application file for complete search history.

(56) References Cited

U.S. PATENT DOCUMENTS

| | | | | |
|---|---|---|---|---|
| 2,608,315 | A | 8/1952 | Turner | |
| 2,956,701 | A | 10/1960 | Larson | |
| 3,080,080 | A | 3/1963 | Miller | |
| 3,232,380 | A * | 2/1966 | Hansen | 187/237 |
| 3,625,385 | A | 12/1971 | Ide | |
| 3,851,779 | A * | 12/1974 | Crawford | 414/667 |
| 4,102,464 | A | 7/1978 | Schuster | |
| 4,478,314 | A | 10/1984 | Dorman | |
| 5,456,565 | A | 10/1995 | Pigott et al. | |
| 5,618,159 | A * | 4/1997 | Wilson | 414/785 |
| 6,206,366 | B1 | 3/2001 | Schmid | |
| 6,702,122 | B2 * | 3/2004 | Hopkins et al. | 211/13.1 |
| 6,902,039 | B2 * | 6/2005 | Kunch | 187/222 |
| 2003/0049116 | A1 * | 3/2003 | Henning | 414/667 |
| 2003/0206792 | A1 | 11/2003 | Kunch | |
| 2004/0007542 | A1 | 1/2004 | Hopkins et al. | |

OTHER PUBLICATIONS

Patent Abstracts of Japan, Dec. 9, 1997, Abstract of JP09315791A.
Patent Abstracts of Japan, Dec. 18, 2002, Abstract of JP2002362891A.

* cited by examiner

*Primary Examiner*—Patrick Mackey
*Assistant Examiner*—Stefan Kruer
(74) *Attorney, Agent, or Firm*—Ingrassia Fisher & Lorenz, P.C.

(57) ABSTRACT

A guard for use with a forklift including a carriage and at least one fork coupled to the carriage. The guard includes a first member configured to be coupled to the carriage, a second member configured to be coupled to the carriage opposite the first member, and a fork interface member extending between the first member and the second member. The fork interface member is adapted to adjustably secure the at least one fork relative to the carriage when the at least one fork is only partially coupled with the carriage. Fork racks and systems for removing, replacing, and/or storing forks provide additional advantages.

26 Claims, 8 Drawing Sheets

FORKLIFT GUARD

BACKGROUND OF THE INVENTION

Industrial forklifts or lift trucks are routinely used in industrial and other applications to lift and transport materials from one location to another. The size and shape of the materials and/or crates containing the materials vary depending upon the application for which the forklift is used. In many instances, one size or style forks of the forklift are not properly configured to carry all sizes and shapes of crates or materials without causing damage to the crate or material. In such instances, the forks of the forklift may be replaced or exchanged with other size or style forks. In addition, forks periodically are removed from the forklift for maintenance of the forklift.

Conventional methods of removing and/or replacing the forks of a forklift require the forks to be unlocked and manually manipulated to remove the forks from the carriage assembly of the forklift and to manually carry the forks to a storage area. Due to the relatively large weight of each fork and its relatively unmanageable size and weight distribution, manual handling of the forks by an individual is not only difficult, but is often times unsafe. In addition, forks removed from the forklift are often stored on the ground, on a pile of pallets, etc., which can additionally provide danger to the user. In particular, placing a fork on the floor can cause unwanted back strain while placing a fork on a pile of pallets may lead to an unstable pile of materials that could topple or cause other damage. Therefore, besides being relatively slow, the above procedure of removing or replacing and storing forks often times contributes to injury such as back strain, pinched fingers, injured toes, etc.

SUMMARY OF THE INVENTION

One aspect of the present invention relates to a guard for use with a forklift including a carriage and at least one fork coupled to the carriage. The guard includes a first member configured to be coupled to the carriage, a second member configured to be coupled to the carriage opposite the first member, and a fork interface member extending between the first member and the second member. The fork interface member is adapted to adjustably secure the at least one fork relative to the carriage when the at least one fork is only partially coupled with the carriage. Other features and advantages are also disclosed.

BRIEF DESCRIPTION OF THE DRAWINGS

Embodiments of the invention will be described with respect to the figures, in which like reference numerals denote like elements, and in which.

DETAILED DESCRIPTION

Figure 1:
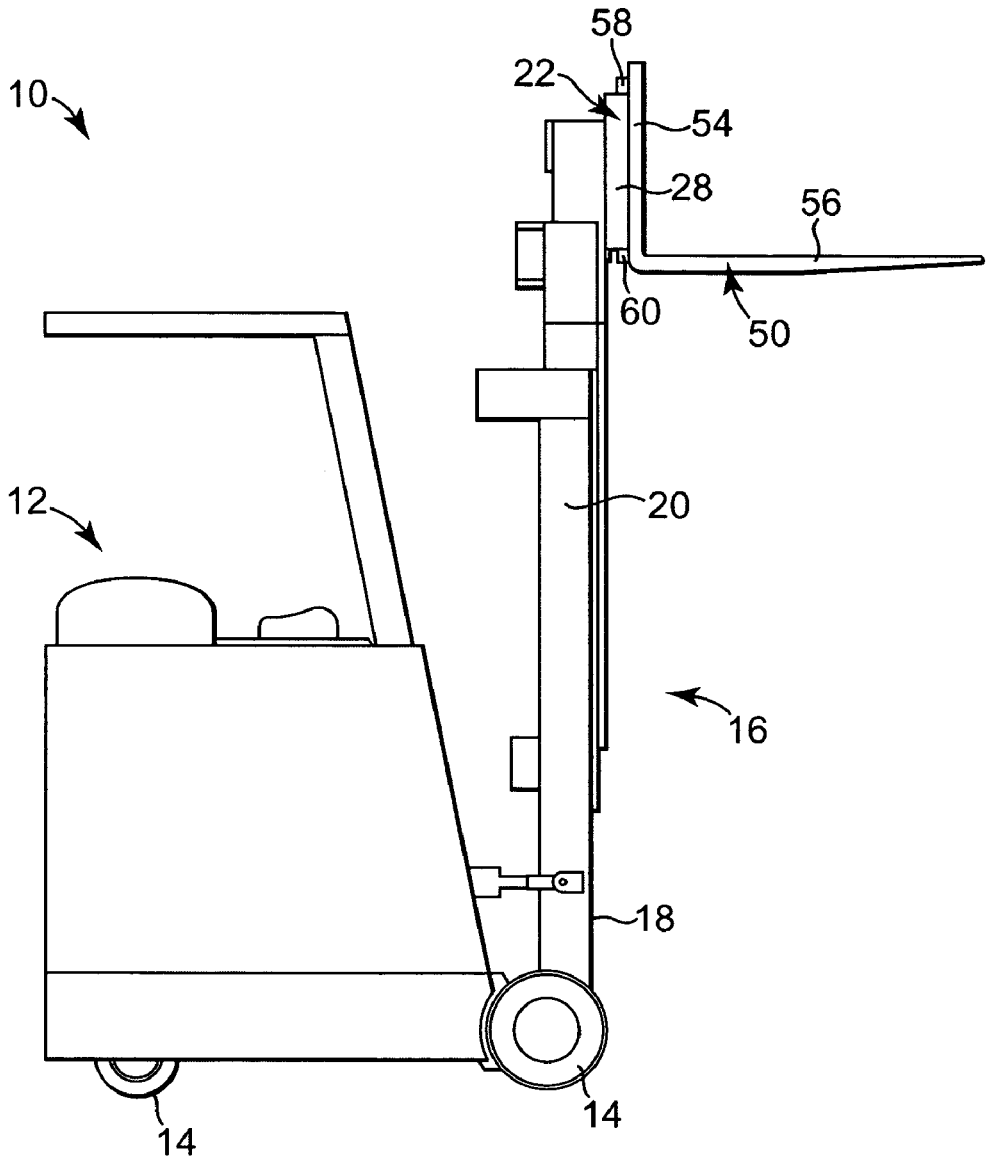
FIG. 1 is a side view of a forklift, according to an embodiment of the present invention.

FIG. 1 illustrates one embodiment of a forklift or lift truck 10 including an operator area or compartment 12 mounted on wheels 14 and a lift mechanism 16. Lift mechanism 16 is mounted to a front 18 of forklift 10 opposite operator area 12. In one embodiment, the operator area includes forklift controls and an area for the operator to ride the forklift 10. Lift mechanism 16 includes a lift support track or mast 20 vertically extending from front 18 of forklift 10 and a carriage 22 for selectively translating up and down lift support track 20. In one embodiment, lift support track 18 is a telescopic mast structure operatively connected to one or more hydraulic cylinders with piston rods (not shown) to actuate carriage 22 along lift support track 20.

Figure 2:
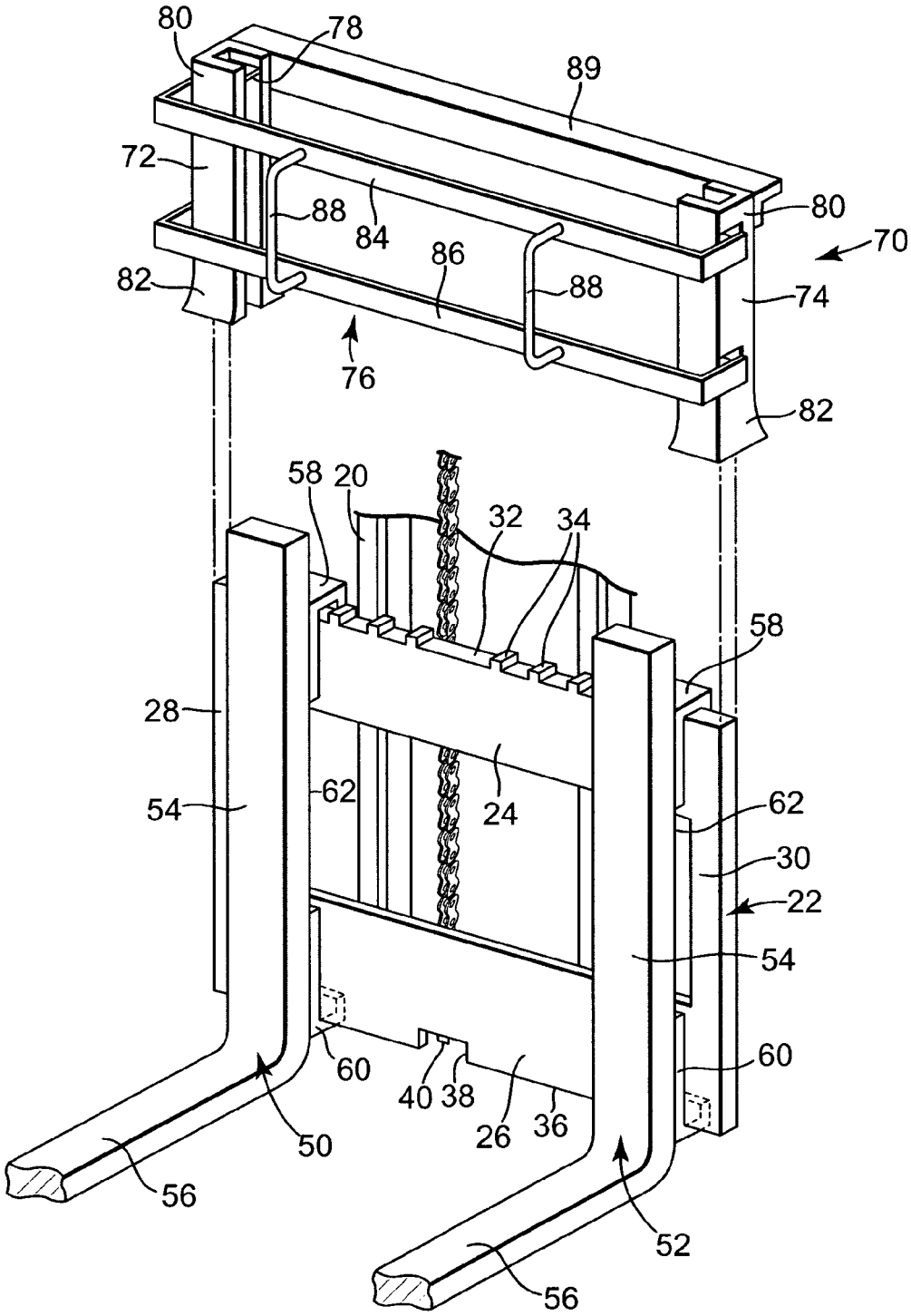
FIG. 2 is an exploded perspective view of a carriage assembly of the forklift of FIG. 1 and a forklift guard, according to one embodiment of the present invention.

In one embodiment illustrated with additional reference to FIG. 2, carriage 22 includes a top support 24, a bottom support 26 opposite top support 24, and two side members 28 and 30 extending between horizontal supports 24 and 26 opposite one another. Top and bottom supports 24 and 26 extend in a substantially horizontal manner and side members 28 and 30 extend in a substantially vertical manner. In one embodiment, top horizontal support 24 defines a top surface 32 including a plurality of teeth 34. Bottom support 26 defines a substantially linear bottom surface 36 and a notch or cavity 38 extending from bottom surface 36 into the remainder of support 26. In one embodiment, a bolt 40 is selectively thread from bottom surface 36, more specifically, the middle of the notch 38, into the bottom support 26. As such, a head of bolt 40 effectively extends into and obstructs notch 38. It should be understood that directional terminology, such as a "horizontal," "vertical," "top," "bottom," "front," "back," etc., are used for purposes of illustration only and are in no way limited.

A first fork 50 and a second fork 52 are selectively coupled to carriage 22. In one embodiment, first fork 50 is generally L-shaped and, accordingly, includes a first and substantially vertical leg 54, a second and substantially horizontal leg 56 extending from vertical leg 54, a first or top hook 58, and a second or bottom hook 60. Top hook 58 is coupled to vertical leg 54 opposite horizontal leg 56. Top hook 58 extends from a back surface 62 of vertical leg 54 and is open or curled toward bottom hook 60. Bottom hook 60 is positioned opposite top hook 58 and extends from back surface 62 of vertical leg 54 to open or curl toward top hook 58. In one embodiment, each hook 58 and 60 is sized to receive a portion of carriage 22.

Typically, first fork 50 is selectively coupled to carriage 22. In particular, top hook 58 and bottom hook 60 of first fork 50 receive top support 24 and bottom support 26 of carriage 22, respectively. Top hook 58 wraps at least partially around top support 24 interacting with top surface 32 of top support 24 between two of the plurality of teeth 34. The two of the plurality of teeth 34 function to facilitate maintenance of top hook 58 in the desired position (i.e., generally prevent inadvertent sliding of top hook 58 along top surface 32). Similarly, bottom hook 60 wraps at least partially around bottom horizontal support 26 and interacts with bottom surface 36 of bottom support 26.

With the above in mind, top hook 58 and bottom hook 60 define a first coupling point and a second coupling point, respectively, of fork 50 to carriage 22. Notably, upon coupling, fork 50 is still selectively adjustable with respect to carriage 22. More specifically, fork 50 is laterally slidable along top and bottom supports 24 and 26. In one embodiment, once positioned, first fork 50 is locked in place along horizontal supports 24 and 26 by activating a lock mechanism (not shown) on first fork 50.

In one embodiment, second fork 52 is formed and used substantially similar to first fork 50 described above. Accordingly, second fork 52 is coupled with carriage 22 in a manner similar to that described above with respect to first fork 50. Accordingly, in one embodiment, second fork 52 also includes a lock mechanism (not shown) to selectively lock second fork 52 in a particular position along horizontal supports 24 and 26. Forks 50 and 52, more specifically, horizontal legs 56 of forks 50 and 52, interact with and support objects during use of forklift 10. Carriage 22, forks 50 and 52, and any supported objects translate up and down lift support track 20 as directed by a user or operator. In addition, forklift 10 is driven to transport the supported objects also as directed by the user. Notably, although illustrated and described as a stand-up truck, in one embodiment, forklift truck 10 is one of a walk-behind truck, a sit-down truck, etc.

Figure 3:
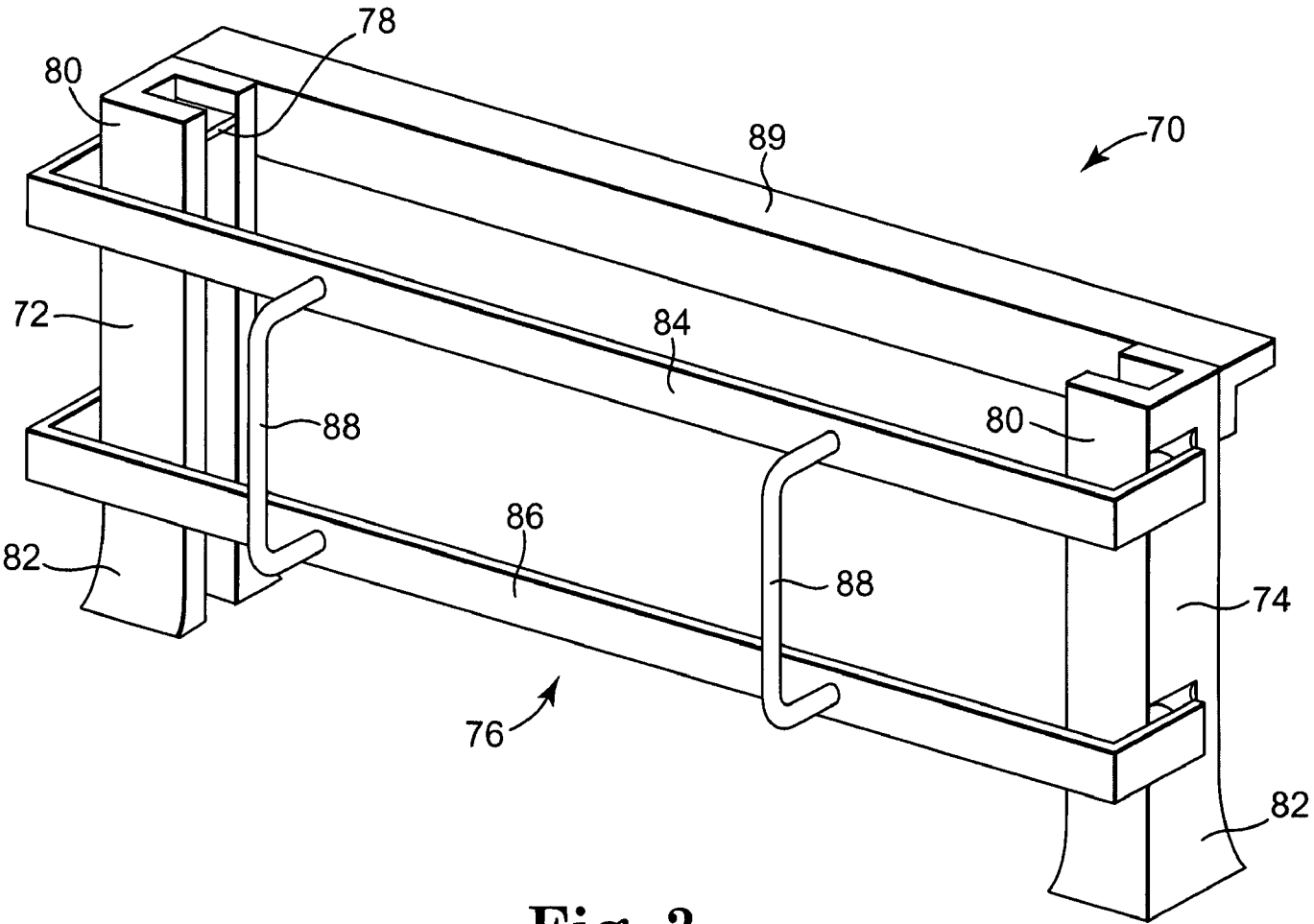
FIG. 3 is a perspective view of the guard of FIG. 2.

Forklift guard 70 is configured to facilitate the process of coupling and/or removing the forks 50 and 52 from carriage 22. Additionally referring to FIG. 3, guard 70 includes a first carriage receiving member or portion 72, a second carriage receiving member or portion 74 opposite first carriage receiving member 70, and a bridge or fork interface member 76. First carriage receiving member 72 is configured to be coupled to first side member 28 of carriage 22. Each of first and second carriage receiving members 70 and 72 is sized, shaped, and positioned to receive first and second side members 28 and 30, respectively. In one embodiment, first carriage receiving member 72 is a channel open toward second carriage receiving member 74, and second carriage receiving member 74 is a channel open toward first carriage receiving member 72.

In one embodiment, each carriage receiving member 72 and 74 includes a stop 78, such as a stop plate or angle, positioned near a top end 80 of each carriage receiving member 72 and 74 and configured to interact with the top support 24 of carriage 22 to stop advancement of guard 70 upon carriage 22, as will be further described below. With this in mind, stop 78 facilitates proper and consistent placement of guard 70 upon carriage 22. In one embodiment, each carriage receiving member 72 and 74 is flared near a bottom end 82, which is opposite top end 80, to facilitate alignment of guard 70 with side members 28 and 30 of carriage 22.

Bridge 76 laterally extends across the fronts of and between first carriage receiving member 72 and second carriage receiving member 74. In one embodiment, bridge 76 also extends forward and outwardly away from first and second carriage receiving members 72 and 74 to offset bridge 76 from carriage receiving members 72 and 74. In one embodiment, bridge 76 consists of two similar elongated and horizontal portions 84 and 86 spaced vertically apart from each other and each extending between first carriage receiving member 72 and second carriage member 74.

In one embodiment, at least one cross bar 88 extends vertically between the two elongated portions 84 and 86 to further stabilize guard 70 against twisting during use. In one embodiment, guard 70 further includes a back support 89 extending between first and second carriage receiving members 72 and 74 to further stabilize guard 70. More particularly, in one embodiment, back support 89 is an angle, tube, or other stock metal piece. Accordingly, in one embodiment, guard 70 is fabricated from stock metal pieces, such as stock steel pieces.

Figure 4:
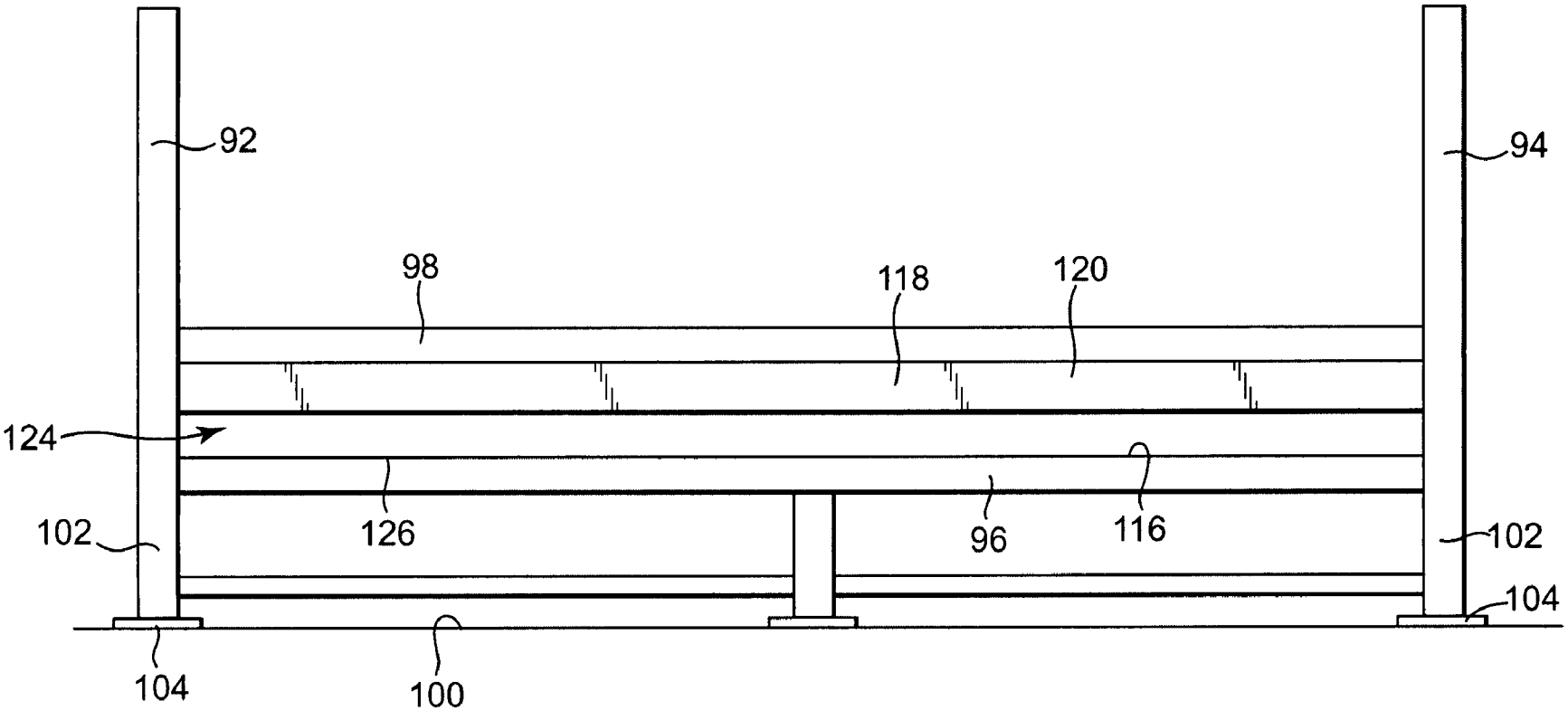
FIG. 4 is front view of a fork storage rack, according to one embodiment of the present invention.
Figure 5:
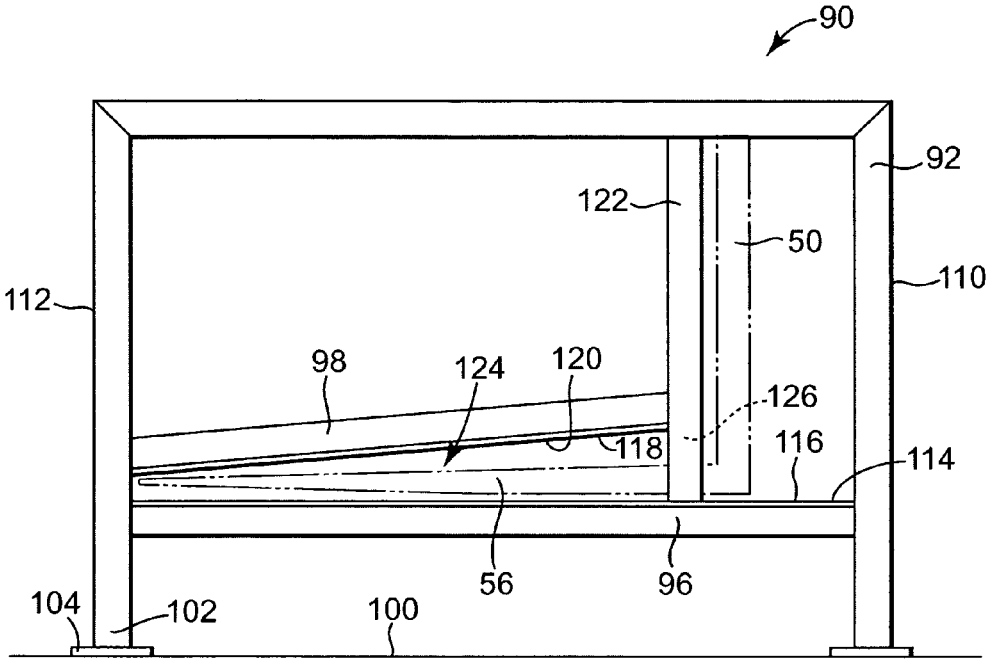
FIG. 5 is a side view of the storage rack of FIG. 4.

In one embodiment, guard 70 is used in conjunction with a fork rack or holder 90, which is collectively illustrated in the front view of FIG. 4 and the side view of FIG. 5. Fork rack 90 is configured to hold a plurality of forks, such as forks 50 and 52, when the forks are not being used with forklift 10. Fork rack 90 includes side frames 92 and 94 opposite each other, support frame 96, and wedge frame 98. Side frames 92 and 94 are configured to interact with a support surface 100, such as a floor or wall to support fork rack 90. Side frames 92 and 94 extend away from support surface 100. In one embodiment, each side frame 92 and 94 includes a support interface portion 102 configured to interact with support surface 100. In one embodiment, at least one support interface portion 102 includes a plate or other member 104 secured with bolts, other device, or substance to support surface 100 to prevent inadvertent movement of rack 90 with respect to support surface 100 during use.

In one embodiment, each side frame 92 and 94 extends above support frame 96 a distance substantially equal to or greater than the height of vertical leg 54 above horizontal leg 56 of each fork 50 and/or 52 to decrease inadvertent interaction with forks 50 and 52 stored in rack 90, which could cause fork 50 and/or 52 to fall or shift within rack 90. In one embodiment, each side frame 92 and 94 is generally fabricated from stock metal materials, such as channels, tubes, angles, and/or plates. In one embodiment, each side frame 92 and 94 is fabricated from steel.

Support frame 96 extends between side frames 92 and 94 and between a front 110 and a back 112 of rack 90 in a substantially horizontal manner. Support frame 96 is generally fabricated from stock metal materials, such as channels, tubes, angles, sheets, and/or plates. In one embodiment, support frame 96 is fabricated from steel. In one embodiment, support frame 96 includes a sheet material 114 extending along the top of support frame 96 to present a generally smooth top surface 116 of support frame 96.

Wedge frame 98 extends between side frames 92 and 94 and from back 112 toward front 110 of rack 90, in particular, to an intermediate vertical support 122 of each side frame 92 and 94 positioned relatively nearer front 110 than back 112 of rack 90. More specifically, wedge frame 98 is vertically positioned nearer support frame 96 at back 112 than near front 110. In one embodiment, wedge frame 98 is vertically positioned relative to support frame 96 at back 112 a distance substantially equal to or less than the thickness of horizontal leg 56 of each fork 50 and 52 opposite vertical leg 54. Wedge frame 98 is generally fabricated from stock metal materials, such as channels, tubes, angles, sheets, and/or plates. In one embodiment, wedge frame 98 is fabricated from steel. In one embodiment, wedge frame 98 includes a sheet material 118 extending along the bottom of wedge frame 98 to present a generally smooth bottom surface 120 of wedge frame 98.

With the above in mind, a storage space 124 is defined in a wedge shape between top surface 116 of support frame 96 and bottom surface 120 of wedge frame 98. Storage space 124 is accessible via a front opening 126 relatively near front 110 of rack 90, and is sized and shaped to receive a plurality of forks, such as forks 50 and 52. In one embodiment, a stop 128 is positioned within storage space 124 opposite opening 126 to interact with horizontal leg 56 opposite vertical leg 54 and to prevent over-insertion of forks 50 and/or 52 into storage space 124. In one embodiment, fork rack 90 includes various other supports and/or features to provide for adequate stability and strength of rack 90 to selectively maintain a plurality of forks, such as forks 50 and 52.

Figure 6:
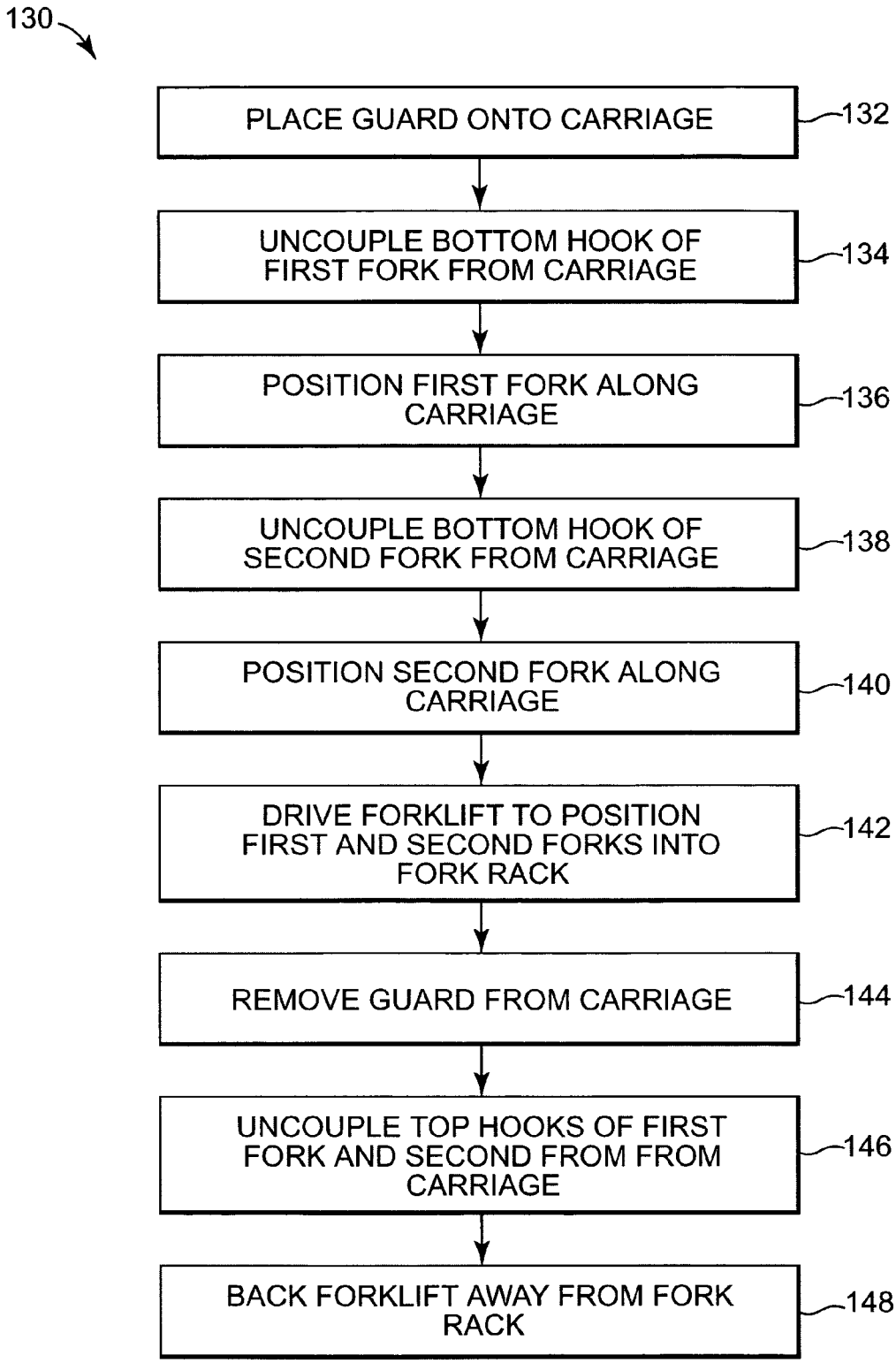
FIG. 6 is a flow chart illustrating a method of removing and storing a fork of the forklift of FIG. 1, according to one embodiment of the present invention.

FIG. 6 illustrates one embodiment of a process for removing forks 50 and 52 from carriage 22 generally at 130. At 132, guard 70 is placed onto carriage 22, which is coupled with forks 50 and 52 for prior use. At 134, bottom hook 60 of first fork 50 is uncoupled from carriage 22. In one embodiment, in order to be able to uncouple bottom hook 60 from carriage 22, bolt 40 is removed from within notch 38 of bottom support 26. In addition, in one embodiment, a lock mechanism or clamp of first fork 50 is released. First fork 50 is laterally slid along horizontal supports 24 and 26 toward the center of carriage 22 until bottom hook 60 is laterally aligned with notch 38.

Figure 7:
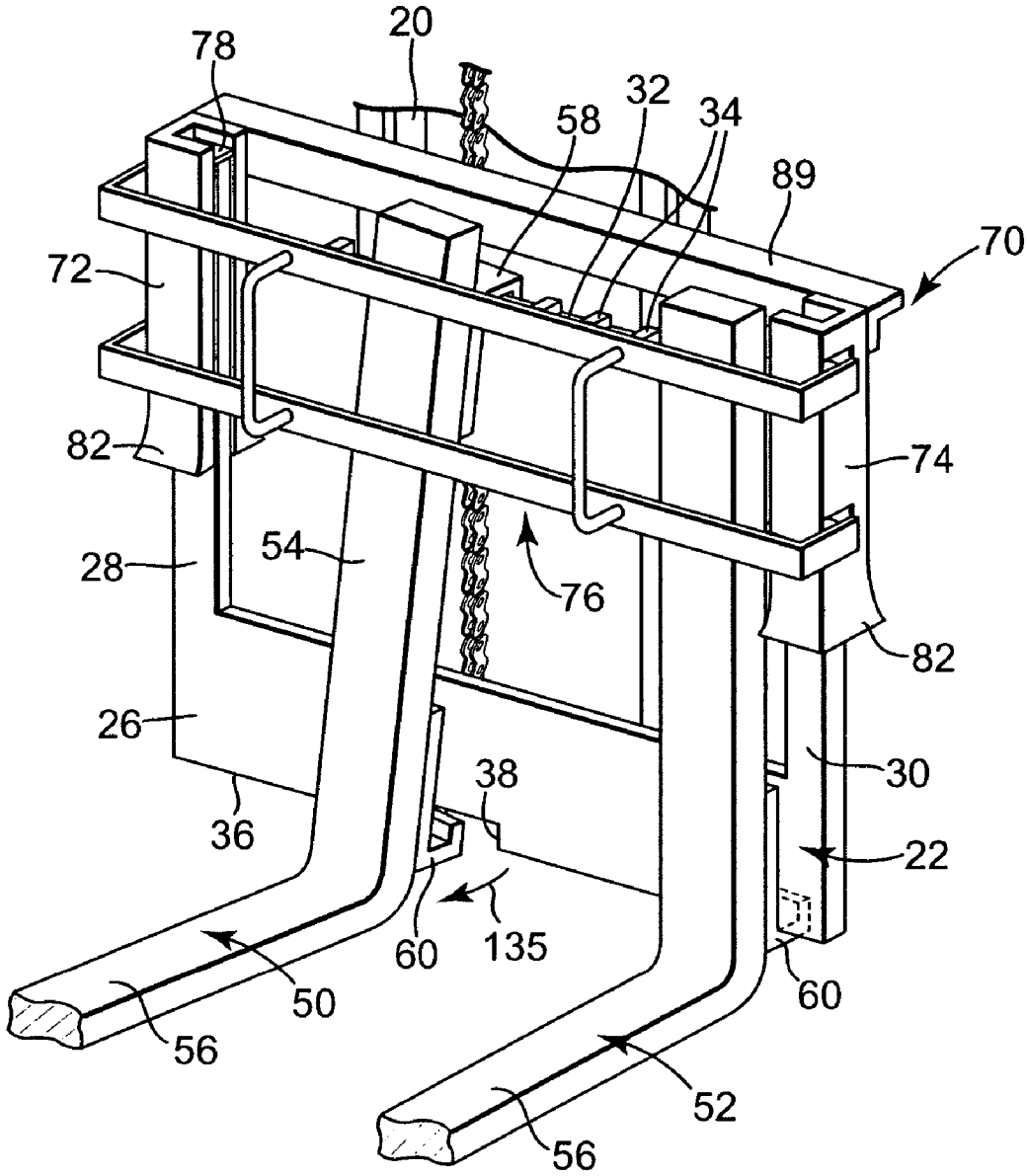
FIG. 7 is a perspective view of the carriage assembly and fork of the forklift of FIG. 1 during the method illustrated in FIG. 6.

Once aligned, as illustrated with additional reference to FIG. 7, first fork 50 is tilted or rotated as indicated by arrow 135 about top hook 58 (i.e., the first coupling point) outwardly away from carriage 22 to move bottom hook 60 through notch 38, thereby, uncoupling bottom hook 60 from bottom support 26 of carriage 22. The now only partially coupled fork 50 is slid along top support 24 of carriage 22 to position fork 50 laterally along carriage 22 as desired. Notably, as fork 50 is slid along top support 24, fork 50 interacts with bridge 76 of guard 70 to restrain additional rotation of fork 50 about top hook 58 that could result in uncoupling of hook 58 from top support 24. In one embodiment, fork 50 is positioned along top support 24 50 as not to interfere with uncoupling of second fork 52, as will be apparent below.

At 138, bottom hook 60 of second fork 52 is uncoupled from carriage 22 in a similar manner as described with respect to first fork 50 at 134. At 140, second fork 52 is laterally positioned as desired by a user along carriage 22. In particular, in one embodiment, second fork 52, which is now only partially coupled to carriage 22, is slid to a position adjacent to first fork 50. Accordingly, second fork 52 also interacts with bridge 76 of guard 70 when slid along top support 24 to restrain additional rotation of fork 52 about top hook 58 that could result in uncoupling of top hook 58 from top support 24.

Forklift 10 with forks 50 and 52 positioned as desired by the user is driven to fork rack 90 at 142. More specifically, forklift 10 is driven to fork rack 90 such that each fork 50 and 52 is received within wedged storage space 124 such that top surface 116 of support frame 96 and bottom surface 120 of wedge frame 98 each contact each horizontal leg 56 at at least one point to collectively apply a resistive force to forks 50 and 52 (Notably, support frame 96 and wedge frame 98 are shown entirely spaced from fork 50 for illustrative purposes only). The resistive force generally prevents inadvertent movement of forks 50 and 52 out of fork rack 90 due to accidental contact with forks 50 and/or 52. In one embodiment, resistive force is sufficient to generally prevent manual movement of forks 50 and/or 52 from rack 90 by a single individual or warehouse worker. In one embodiment, resistive force is a compressive force.

Once forks 50 and 52 are positioned within storage space 124 of rack 90, at 144, guard 70 is removed from carriage 22. In an alternative embodiment, guard 70 is removed at 144 prior to advancement and positioning of forks 50 and 52 into rack 90 at 142. Removal of guard 70 allows top hooks 58 of each fork 50 and 52 to be lifted from top support 24, and thereby, uncoupled from carriage 22 at 146. Once forks 50 and 52 are fully uncoupled from carriage 22, at 148, forklift 10 is driven or backed away from rack 90 leaving forks 50 and 52 independently and securely maintained by rack 90. Forklift 10 is then ready for maintenance of or for receiving different forks or other attachments.

It should be noted that use of guard 70, generally prevents or decreases incidents in which an operator manually lifts, and removes, and manipulates each fork 50 and 52 from carriage 22. By decreasing the manual stages of lifting, removing, and manipulating the relatively heavy forks 50 and 52, which typically weigh in excess of 115 pounds, the incidence of related injuries such as pinched fingers, injured toes, etc. are also decreased.

Figure 8:
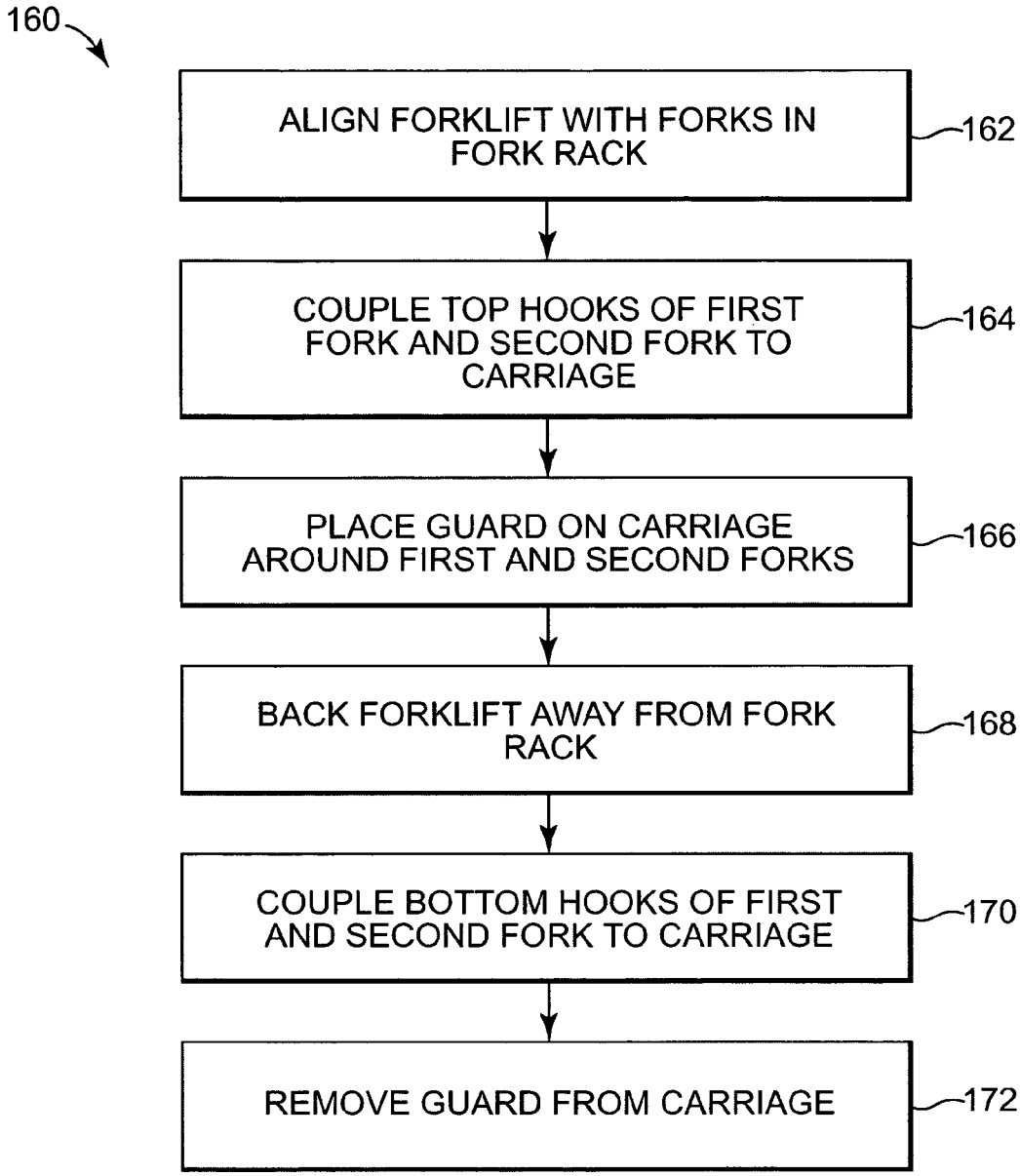
FIG. 8 is a flow chart illustrating a method of replacing a fork on the forklift of FIG. 1, according to one embodiment of the present invention.

FIG. 8 illustrates one embodiment of a process for replacing or coupling forks 50 and 52 to carriage 22 of forklift 10 generally at 160. At 162, forklift 10 is driven to and aligned with rack 90 that is currently storing forks 50 and 52 such that carriage 22 is positioned to receive forks 50 and 52. More particularly, carriage 22 is driven from front 110 of rack 90, between side frames 92 and 94, and toward forks 50 and 52, which are each maintained in storage space 124. At 164, top hooks 58 are placed over and to receive top support 24 of carriage 22 to partially couple forks 50 and 52 to carriage 22 at a first coupling point as described above.

Following partial coupling of forks 50 and 52 to carriage 22, at 166, guard 70 is placed upon and, thereby, coupled with carriage 22. In particular, each carriage receiving member 72 and 74 is slid onto each side member 28 and 30 until stops 78 interact with side members 28 and 30. With this in mind, each fork 50 and 52 is interposed between bridge 76 of guard 70 and carriage 22. Accordingly, bridge 76 of carriage 22 interacts with forks 50 and 52 to limit movement and/or rotation of forks 50 and 52 that could cause inadvertent uncoupling of forks 50 and/or 52 from top support 24 of carriage 22. Once guard 70 is secured to carriage 22, forklift 10 and, therefore, carriage 22 and forks 50 and 52 are driven away from, more particularly, backed away from, fork rack 90 at 168.

At 170, bottom hooks 60 of forks 50 and 52 are coupled with carriage 22. More specifically, second fork 52 is laterally slid along top support 24 toward the center of carriage 22. Second fork 52 is rotated back toward carriage 22 about top hook 58 in a direction opposite that illustrated by arrow 135 of FIG. 7 such that bottom hook 60 moves through notch 38 to receive bottom support 26 of carriage 22. Once bottom hook 60 is coupled with bottom support 26, second fork 52 is slid along top and bottom supports 24 and 26 toward side member 30 and positioned as desired by the user.

Bottom hook 60 of first fork 50 is coupled with bottom support 26 of carriage 22 in a similar manner as described with respect to bottom hook 60 of second fork 52. First fork 50 is slid along top and bottom supports 24 and 26 toward side member 28 and positioned as desired by the user. In one embodiment, each fork 50 and 52 is additionally locked in place along carriage 22 by the lock mechanism included on each fork 50 and 52. Bolt 40 is replaced in notch 38 to occlude notch 38. Upon final coupling of each fork 50 and 52 with carriage 22, at 172, guard 70 is removed from carriage 22 and forklift 10 is ready for operation. In one embodiment, step 172 is not performed, and forklift 10 is operated with guard 70 still coupled with carriage 22.

Notably, throughout removal process 130 and/or replacement process 160, carriage 22 can be raised or lowered along lift support track 20 to facilitate access to one or more of bolt 40, forks 50 and 52, carriage 22, etc. In one embodiment, safety cones, flags, or other easily identifiable marker is placed on horizontal leg 56 of each fork 50 and 52 whenever carriage 22 is raised to position forks 50 and 52 above about 3 feet from support surface 100 in order to prevent warehouse workers or other individuals from accidentally or inadvertently bumping into or forcefully contacting horizontal leg 56, which could lead to injuries, such as head injuries.

As described in the above embodiments, use of a forklift guard according to the present invention in the removal and installation of forks or tines to a forklift carriage generally prevents or at least decreases the incidents of user injuries, by decreasing the manual handling of the forks. In particular, the guard retains the forks relatively close to the carriage during repositioning along the carriage to prevent inadvertent removal of the forks from the carriage. The guard also adjustably secures each fork to the carriage when each fork is only partially coupled to the carriage. The securement of the forks prevents dropping of the forks from the carriage, and therefore, prevents injuries such as pinched fingers or toes.

When the forks are adjustably secured to the carriage, the entire forklift can be driven to place the forks in a storage location prior to final removal of the forks from the carriage. Mechanical driving to move the forks, in turn, eliminates the manual carrying or transportation of the forks by the user, and therefore, decrease related injuries, such as back strain, pinched fingers, and injured toes. In addition, use of a storage rack which selectively maintains the forks and applies a resistive force to prevent manual movement of the forks from the rack further provides safety and other advantages and discourages manual transport of the forks from the rack.

What is claimed is:

1. A guard for use with a forklift including a carriage and at least one fork coupled to the carriage, the guard comprising:

a first member configured to be readily removably coupled to the carriage;

a second member configured to be readily removably coupled to the carriage opposite the first member; and a fork interface member extending between the first member and the second member;

wherein the fork interface member is configured to adjustably secure the at least one fork relative to the carriage when the at least one fork is only partially coupled with the carriage, and wherein during use, the at least one fork is interposed between the carriage and the fork interface member, wherein the at least one fork remains coupled to the carriage when the first member and the second member are removed from the carriage.

2. The guard of claim 1, wherein the fork interface member is substantially rigid.

3. The guard of claim 1, wherein the fork interface member is configured to interact with a substantially vertical portion of the at least one fork.

4. The guard of claim 1, wherein the at least one fork includes a first fork and a second fork, and the fork interface member is configured to adjustably secure each of the first fork and the second fork relative to the carriage when each of the first fork and the second fork is only partially coupled with the carriage.

5. The guard of claim 1, wherein each of the first member and the second member includes a stop configured to interact with the carriage to facilitate proper positioning of the guard with respect to the carriage and the at least one fork.

6. The guard of claim 1, wherein the fork interface member is configured to interface with a front face of the at least one fork.

7. The guard of claim 1, in combination with the forklift including the carriage and the at least one fork.

8. A guard for use with a forklift including a carriage and at least one fork coupled to the carriage, the guard comprising:

a first member configured to be readily removably coupled to the carriage;

a second member configured to be readily removably coupled to the carriage opposite the first member; and a fork interface member extending between the first member and the second member;

wherein the fork interface member is configured to adjustably secure the at least one fork relative to the carriage when the at least one fork is only partially coupled with the carriage, and wherein during use, the at least one fork is interposed between the carriage and the fork interface member, wherein the fork interface member is configured to adjustably secure the at least one fork relative to the carriage by generally preventing rotation of the at least one fork about a coupling point between the at least one fork and the carriage.

9. The guard of claim 8, wherein the fork interface member includes a first extension piece and a second extension piece each extending between the first member and the second member, and each of the first extension piece and the second extension piece is configured to contact the at least one fork member to collectively decrease rotation of the at least one fork about the coupling point.

10. The guard of claim 8, in combination with the forklift including the carriage and the at least one fork.

11. A safety device for use with a lift truck having at least one tine selectively coupled thereto, the safety device comprising:

a fork interface member;

means for selectively coupling the fork interface member with the lift truck; such that the at least one tine is interposed between the fork interface member and a portion of the lift truck to limit rotation of the at least one tine during periods of partial coupling of the at least one tine with the lift truck;

wherein the means for selectively coupling the fork interface member is configured to be uncoupled from the lift truck during lift truck use when the at least one tine is fully coupled with the lift truck.

12. The safety device of claim 11, wherein the means for selectively coupling the fork interface member with the lift truck includes means for decreasing rotation of the at least one tine about a single coupling point between the at least one tine and the lift truck.

13. The safety device of claim 11, wherein the means for stabilizing allows the at least one tine to be slidably repositioned with respect to the lift truck and the safety device.

14. The safety device of claim 11, wherein the means for interposing the at least one tine of the lift truck includes means for interposing a first tine and a second tine of the lift truck.

15. The safety device of claim 11, further comprising means for stopping advancement of the means for being selectively coupled with the lift truck relative to the lift truck during coupling, wherein the means for stopping advancement facilitate proper positioning of the safety device with respect to the lift truck and the at least one tine associated with the lift truck.

16. The safety device of claim 11, further comprising means for stabilizing the safety device against twisting during use.

17. The safety device of claim 11, in combination with the lift truck.

18. A guard for use with a forklift including a carriage and at least one fork coupled to the carriage, the guard comprising:

a first member configured to be readily removably coupled to the carriage;

a second member configured to be readily removably coupled to the carriage opposite the first member; and a fork interface member extending between the first member and the second member;

wherein the fork interface member is configured to adjustably secure the at least one fork relative to the carriage when the at least one fork is only partially coupled with the carriage, and wherein the carriage includes a first substantially vertical member and a second substantially vertical member opposite the first substantially vertical member, and wherein the first member of the guard is configured to slidably receive the first substantially vertical member, and the second member of the guard is configured to slidably receive the second substantially vertical member.

19. The guard of claim 18, in combination with the forklift including the carriage and the at least one fork.

20. A guard for use with a forklift including a carriage and at least one fork coupled to the carriage, the guard comprising:

a first member configured to be readily removably coupled to the carriage;

a second member configured to be readily removably coupled to the carriage opposite the first member; and a fork interface member extending between the first member and the second member;

wherein the fork interface member is configured to adjustably secure the at least one fork relative to the carriage when the at least one fork is only partially coupled with the carriage, and wherein the first member is a channel open toward the second member, and the second member is a channel open toward the first member, wherein each of the first member and the second member is configured to receive a portion of the carriage.

21. The guard of claim 20, in combination with the forklift including the carriage and the at least one fork.

22. A guard for use with a forklift including a carriage and at least one fork coupled to the carriage, the guard comprising:

a first member configured to be readily removably coupled to the carriage;

a second member configured to be readily removably coupled to the carriage opposite the first member; and a fork interface member extending between the first member and the second member;

wherein the fork interface member is configured to interface with a front face of the at least one fork and is configured to adjustably secure the at least one fork relative to the carriage when the at least one fork is only partially coupled with the carriage, and wherein the fork interface member includes two elongated members vertically spaced from one another and each extending between the first member and the second member, wherein each of the two elongated members is configured to interface with a front face of the at least one fork, wherein the at least one fork remains coupled to the carriage when the first member and the second member are removed from the carriage.

23. The guard of claim 22, in combination with the forklift including the carriage and the at least one fork.

24. A guard for use with a forklift including a carriage and at least one fork coupled to the carriage, the guard comprising:

a first member configured to be readily removably coupled to the carriage;

a second member configured to be readily removably coupled to the carriage opposite the first member; and a fork interface member extending between the first member and the second member;

wherein the fork interface member is configured to adjustably secure the at least one fork relative to the carriage when the at least one fork is only partially coupled with the carriage, and wherein when the first member and the second member are coupled with the carriage, the fork interface member is positioned to decrease rotation of the at least one fork about a coupling point between the at least one fork and the carriage relative to the carriage.

25. The guard of claim 24, in combination with the forklift including the carriage and the at least one fork.

26. The safety device of claim 15, wherein means for being selectively coupled with the lift truck, includes a first and second means for each receiving a different portion of the lift truck, wherein each of the first and second means for each receiving include means for stopping.

* * * * *